US005865124A

United States Patent [19]

Wroe

[11] Patent Number: 5,865,124

[45] Date of Patent: Feb. 2, 1999

[54] TABLE ATTACHMENT FOR LAWN CHAIRS AND THE LIKE

[76] Inventor: Dwight W. Wroe, Box 8361, Red Bluff, Calif. 96080

[21] Appl. No.: 974,605

[22] Filed: Nov. 19, 1997

[51] Int. Cl.[6] ..... A47B 85/00

[52] U.S. Cl. ..... 108/26; 108/157.11; 108/157.15; 108/158.12; 297/170; 297/188.2; 403/103; 285/913

[58] Field of Search ..... 108/26, 157.11, 108/158.11, 157.15, 158.12, 49; 297/170, 171, 188.2, 188.18, 188.21; 248/218.4; 11/219.4; 403/103; 285/913

[56] References Cited

U.S. PATENT DOCUMENTS

| | | | |
|---|---|---|---|
| 3,089,438 | 5/1963 | Paradise | 108/26 |
| 3,586,367 | 6/1971 | Cincotta . | |
| 4,662,676 | 5/1987 | Havelock | 108/26 X |
| 4,733,442 | 3/1988 | Asai | 285/913 X |
| 4,861,102 | 8/1989 | Fuller . | |
| 5,356,107 | 10/1994 | Sinohuiz . | |
| 5,431,507 | 7/1995 | Smilanick | 285/913 X |
| 5,573,301 | 11/1996 | Scott . | |
| 5,647,075 | 7/1997 | Perkins | 108/26 X |
| 5,765,911 | 6/1998 | Sorenson . | |

FOREIGN PATENT DOCUMENTS

| | | | |
|---|---|---|---|
| 1229105 | 9/1960 | France | 297/170 |
| 662928 | 12/1951 | United Kingdom | 108/49 |

*Primary Examiner*—Peter M. Cuomo
*Assistant Examiner*—Hanh V. Tran
*Attorney, Agent, or Firm*—Robert M. Sperry

[57] ABSTRACT

An improved table attachment for lawn chairs and the like comprising a gripping foot having a pair of semi-cylindrical members which are frictionally engageable to clamp about a leg of a chair on which the table attachment is to be mounted, one of the semi-cylindrical members having an externally-threaded neck portion projecting outward and upward therefrom, a tubular angle member having an internally-threaded end mateable with the neck portion and having a the opposite end castellated, a generally fan-shaped table platform having an opening formed adjacent the narrow end thereof for receiving a drinking glass and having a shaft projecting downwardly from the table platform adjacent the narrow end formed with a castellated interior mateable with the opposite end of the angle member.

11 Claims, 4 Drawing Sheets

TABLE ATTACHMENT FOR LAWN CHAIRS AND THE LIKE

FIELD OF INVENTION

This invention relates to recreational furniture and the like and is particularly directed to improved table attachments for lawn chairs and the like.

PRIOR ART

Recreational furniture, such as lawn chairs, beach chairs and the like are widely used. However, very few such chairs provide table attachments to facilitate their use when serving snacks, meals and the like or for storing magazines, books, writing material when the user is not actually using such materials. Some prior art lawn chairs have provided table attachments which swing overhead to permit storage behind the chair, when not in use. However, when in use, these overhead table attachments prevent the user from rising out of the chair. Also, when in the stored position, the overhead table attachments hang behind the chair in a vertical position which is useless. Other table attachments are complex and are difficult to attach and use, while others are expensive to produce and purchase. Thus, none of the prior art table attachments are entirely satisfactory.

BRIEF SUMMARY AND OBJECTS OF INVENTION

These disadvantages of the prior art are overcome with the present invention and an improved table attachment is provide which is simple and inexpensive to produce and purchase and is easy to attach, detach and to move between a storage position and a utility position, yet which is useful in both the storage and utility positions.

The advantages of the present invention are preferably attained by providing an improved table attachment comprising a gripping foot having a pair of semi-cylindrical members which are frictionally engageable to clamp about a leg of a chair on which the table attachment is to be mounted, one of said semi-cylindrical members having an externally-threaded neck portion projecting outward and upward therefrom, a tubular angle member having an internally-threaded end mateable with said neck portion of said one of said semi-cylindrical members and having a the opposite end castellated, a generally fan-shaped table platform having an opening formed adjacent the narrow end thereof for receiving a drinking glass and having a shaft projecting downwardly from said table platform adjacent said narrow end formed with a castellated interior mateable with said opposite end of said angle member.

Accordingly, it is an object of the present invention to provide an improved table attachment for recreational furniture.

Another object of the present invention is to provide an improved table attachment for lawn chairs and the like.

An additional object of the present invention is to provide an improved table attachment for lawn chairs and the like which is simple and inexpensive to produce and purchase.

A further object of the present invention is to provide an improved table attachment for lawn chairs and the like which is easy to attach, detach and to move between a storage position and a utility position.

An additional object of the present invention is to provide an improved table attachment for lawn chairs and the like which is easy to attach, detach and to move between a storage position and a utility position, yet which is useful in both the storage and utility positions.

A specific object of the present invention is to provide an improved table attachment for lawn chairs and the like comprising a gripping foot having a pair of semi-cylindrical members which are frictionally engageable to clamp about a leg of a chair on which the table attachment is to be mounted, one of said semi-cylindrical members having an externally-threaded neck portion projecting outward and upward therefrom, a tubular angle member having an internally-threaded end mateable with said neck portion of said one of said semi-cylindrical members and having a the opposite end castellated, a generally fan-shaped table platform having an opening formed adjacent the narrow end thereof for receiving a drinking glass and having a shaft projecting downwardly from said table platform adjacent said narrow end formed with a castellated interior mateable with said opposite end of said angle member.

These and other objects and features of the present invention will be apparent from the following detailed description, taken with reference to the figures of the accompanying drawing.

DETAILED DESCRIPTION OF THE INVENTION

Figure 1:
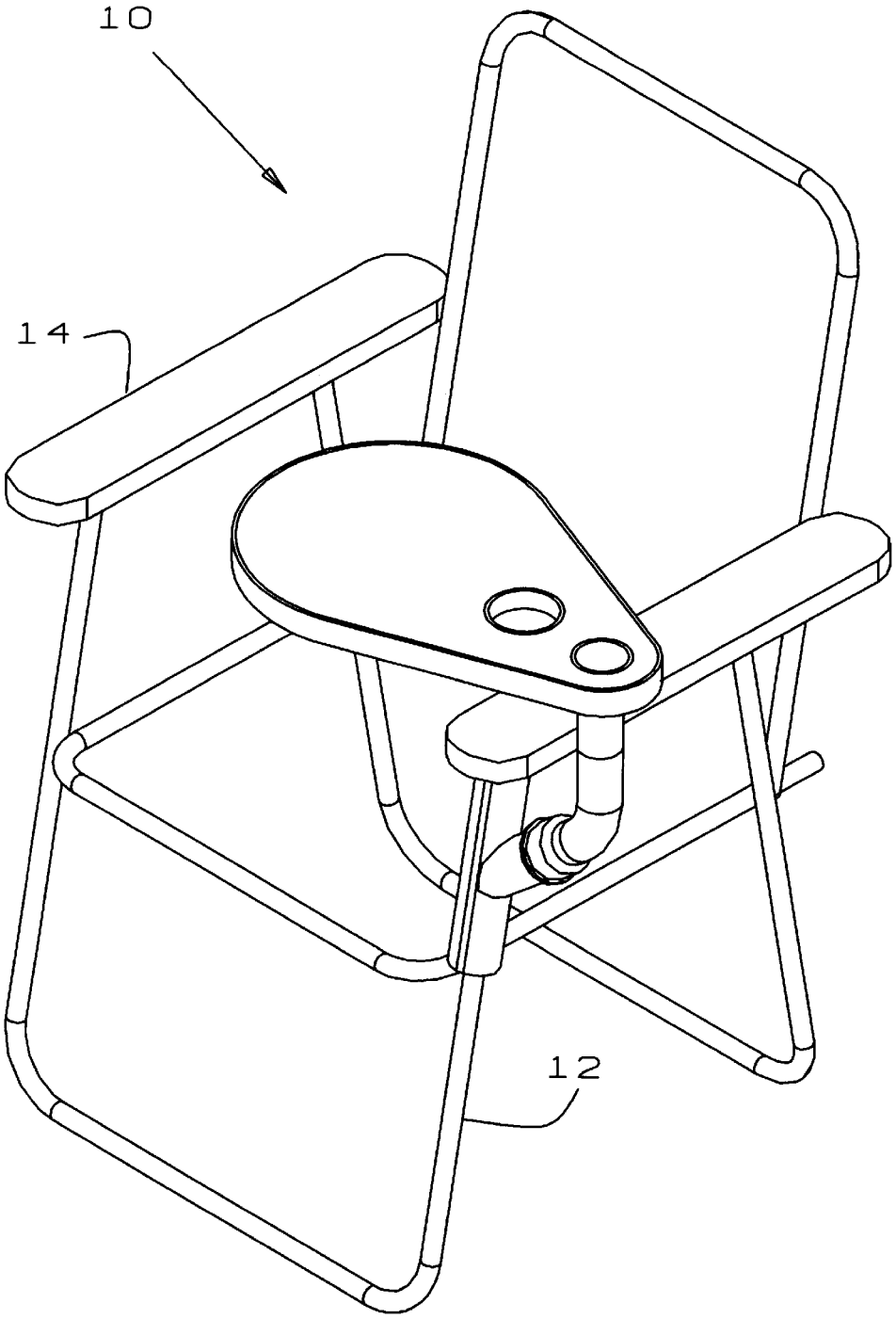
FIG. 1 is a front view of a lawn chair having the table attachment of the present invention mounted thereon.
Figure 2:
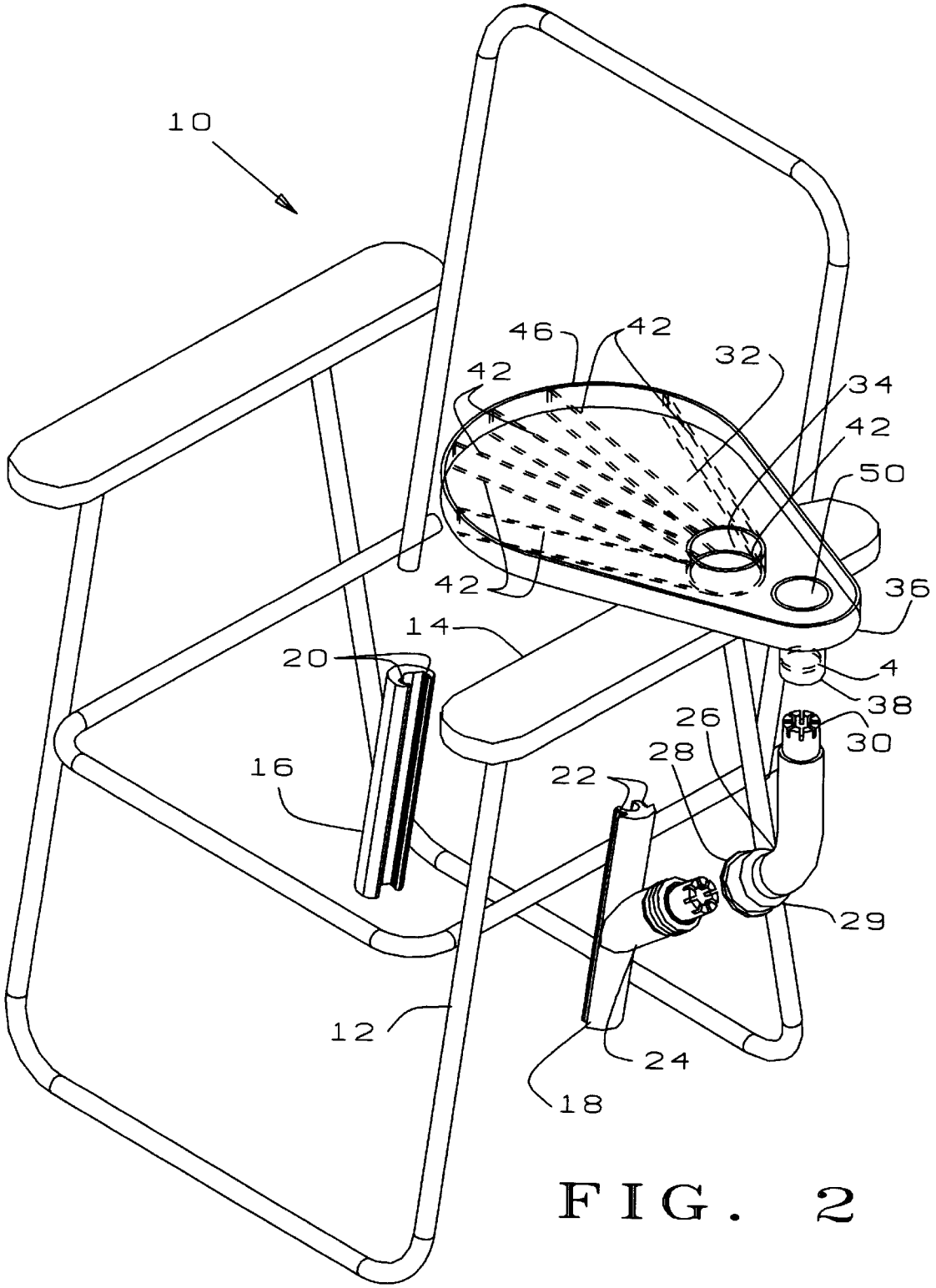
FIG. 2 is an exploded view of the table attachment of FIG. 1.
Figure 3:
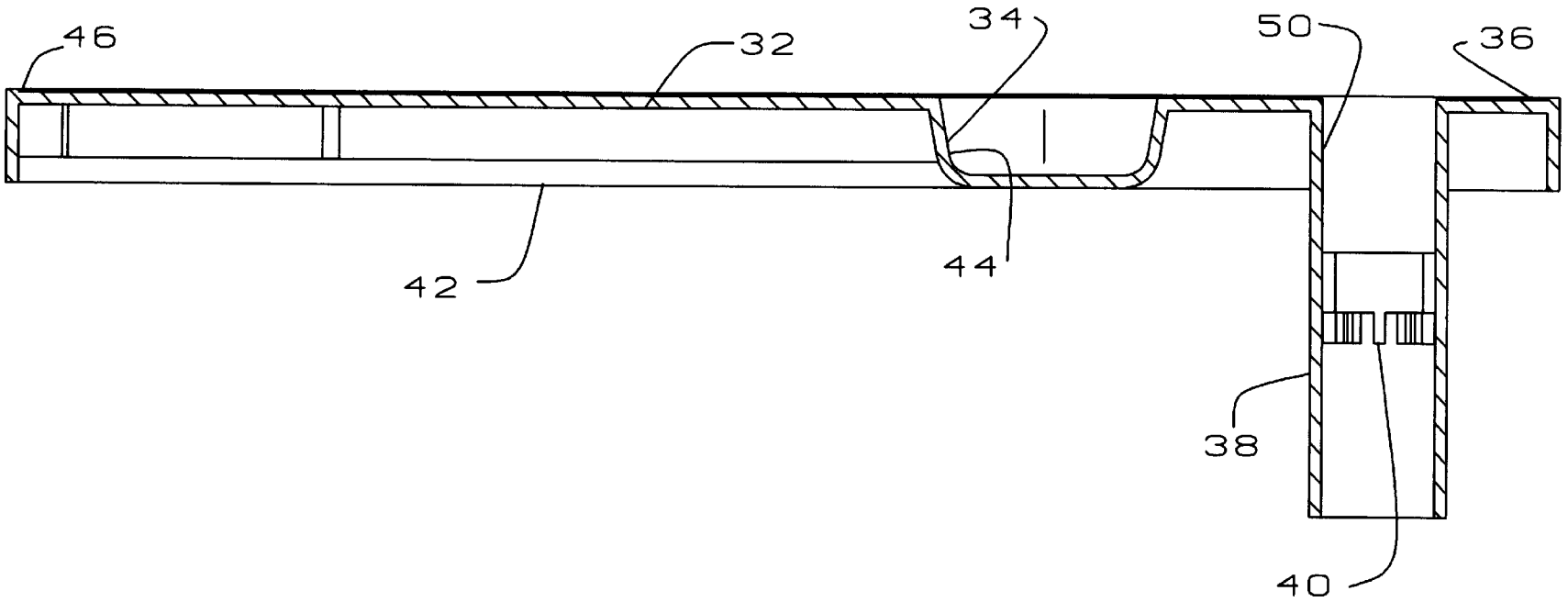
FIG. 3 is a vertical section through the table platform of the table attachment of FIG. 1.

In that form of the present invention chosen for purposes of illustration, FIG. 1 shows a table attachment, indicated generally at 10 mounted on the leg 12 of a typical lawn chair 14. As best seen in FIG. 2, the table attachment 10 comprises a gripping foot having a pair of semi-cylindrical members 16 and 18 which are frictionally engageable to clamp about leg 12 of the lawn chair 14. One of said semi-cylindrical members, for example, member 16, is formed with a plurality of parallel recesses 20 extending along the inner edges thereof, while the opposite one of the semi-cylindrical members, in this case member 18, is provided with at least on outwardly projecting flange 22 extending along each edge thereof and engageable with the recesses 20 of member 16 to firmly, yet releasably hold the members 16 and 18 in clamping relation about the leg 12 of the chair 14. Member 18 is also provided with an externally-threaded neck portion 24 projecting outward and upward therefrom to receive a tubular angle member 26 having an internally-threaded collar 28, which is freely rotatable about the adjacent end 29 of the angular member 26 and is mateable with the neck portion 24 of member 18 and having a the opposite end 30 castellated. A generally fan-shaped table platform 32 is provided, having an opening 34 formed adjacent the narrow end 36 of the platform 32 for receiving a drinking glass or the like and having a tube 38 projecting downwardly from the table platform 32 adjacent the narrow end 36 formed with an interiorly castellated end portion 40 which is mateable with the castellated opposite end 30 of angle member 26. As seen in FIGS. 2 and 3, the table platform 32 is preferably formed with a plurality of strengthening ribs 42 which radiate from an annular cup holder 44 extending downwardly from the opening 34. Also, if desired, a flange 46 may be provided extending about the periphery of the table platform 32 to prevent articles from sliding off of the table platform 32.

In use, the semi-cylindrical members 16 and 18 are clamped about the leg 12 of the chair 14 to firmly, yet releasably, attach the table attachment 10 to the chair 14. Next, angular member 26 is threadedly attached to neck portion 24 of semi-cylindrical member 18 and the interiorly castellated end portion 40 of tube 38 is mated with castellated end 30 of the angle member 26. By appropriately mating the castellated portions 30 and 40, the rotational position of the table platform 32 can be adjusted substantially as desired. Also, because the collar 28 is freely rotatable about end 29 of angle member 26, the angle member 26 may easily be oriented to ensure that shaft 38 is maintained in a vertical position. Flange 46 serves to prevent articles from sliding off of the table platform 32, while ribs 42 and cup holder 44 serve to strengthen the table platform 32.

Figure 4:
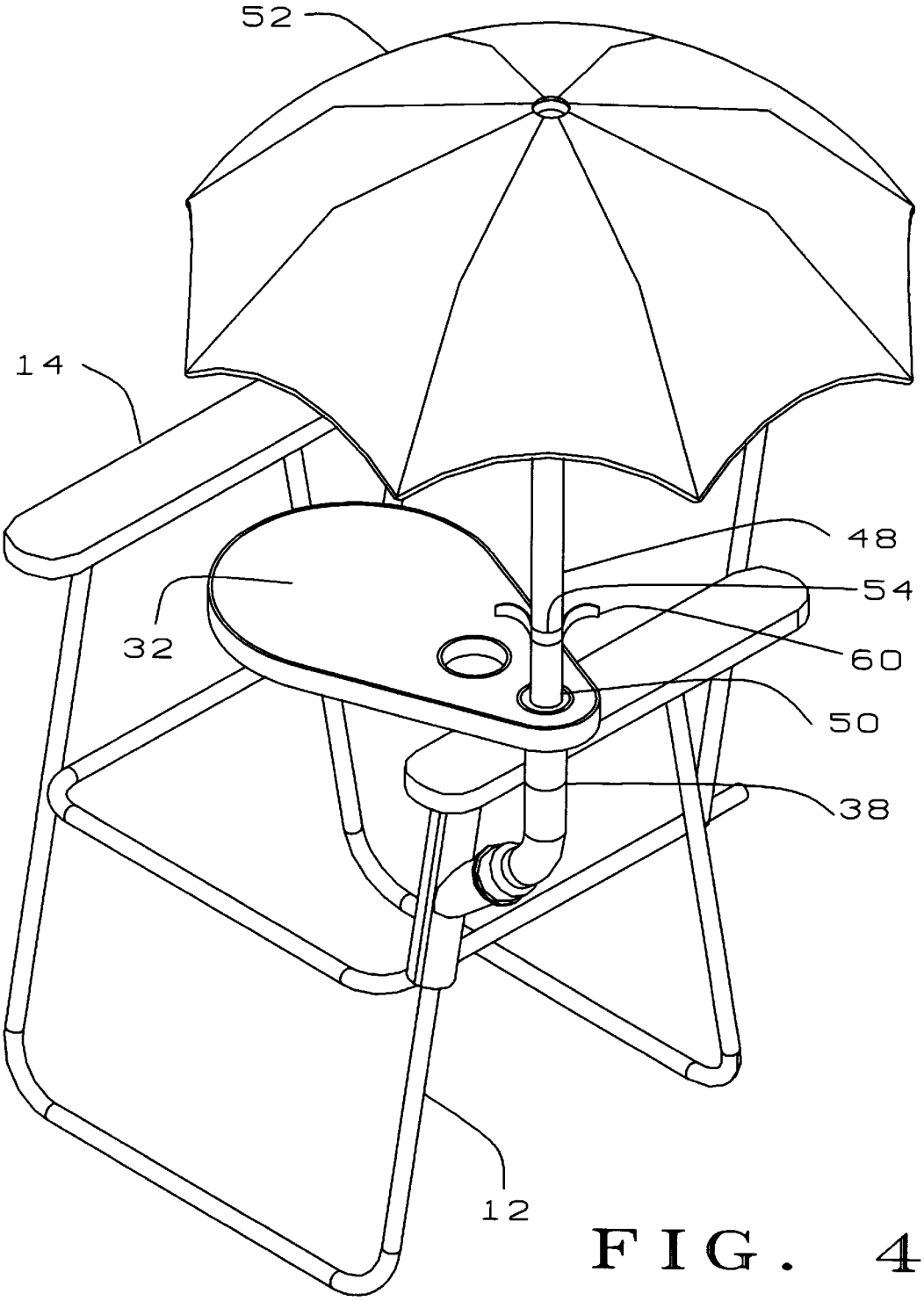
FIG. 4 is a front view of the lawn chair of FIG. 1 with an umbrella attachment mounted on the table attachment of the present invention.

As seen in FIG. 4, if desired, a shaft 48 may be frictionally inserted in the open upper end 50 of tube 38 of the table platform 32 and extends upward therefrom to support desired means, such as umbrella 52, and is attached to the shaft 48 by suitable means such as strap 54. Strap 54 is attached to the tube 38 and carries releasable fastening means 60 located adjacent the free ends of strap 54, such as tabs of hook-and-loop material. If desired, other means, such as a lamp, mist sprayer or other suitable device can also be attached to the upper end of the shaft 48 by clamp 54 or the like.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A table attachment for lawn chairs having a leg, said table attachment comprising:

a gripping foot having a pair of semi-cylindrical members which are frictionally engageable to clamp about said leg of said chair, one of said semi-cylindrical members having an externally-threaded neck portion projecting outward and upward therefrom, a tubular angle member having an internally threaded end mateable with said neck portion of said one of said semi-cylindrical members and having the opposite end castellated, a table platform having a tube projecting downwardly from said table platform with a castellated interior mateable with said opposite end of said angle member.

2. The attachment of claim 1 wherein:

one of said semi-cylindrical members has at least one recess extending vertically along an edge thereof and the other of said semi-cylindrical members has at least one flange engageable with the recess of said one semi-cylindrical member to firmly, yet releasable, clamp said semi-cylindrical members about said leg.

3. The attachment of claim 2 wherein:

said one of said semi-cylindrical members is formed with a plurality of parallel recesses.

4. The attachment of claim 2 wherein:

said other of said semi-cylindrical members is formed with a plurality of parallel flanges.

5. The attachment of claim 1 wherein:

said table platform is formed with an opening for receiving a drinking glass.

6. The attachment of claim 1 wherein:

said table platform is generally fan-shaped.

7. The attachment of claim 6 wherein:

said tube projects downward adjacent the narrow end of said table platform.

8. The attachment of claim 1 wherein:

said table platform is formed with a plurality of strengthening ribs.

9. The attachment of claim 5 wherein:

said table platform has an annular cup holder extending downwardly from said opening for receiving a drinking glass.

10. The attachment of claim 1 wherein:

said tube is mounted in an opening formed in said table platform, a shaft is frictionally inserted into the upper end of said tube, and a desired device is releasably mounted on said shaft.

11. The attachment of claim 1 wherein:

said internally threaded end of said angle member comprises an internally threaded collar freely rotatably mounted on said end and mateable with said neck portion of said one of said semi-cylindrical members to enable said angle member to allow said angle member to be oriented vertically.

* * * * *